US005610364A

United States Patent [19]

Endicott, Jr. et al.

[11] Patent Number: 5,610,364

[45] Date of Patent: Mar. 11, 1997

[54] NOZZLE PLUG FOR PLUME ENHANCEMENT IN A KINEMATIC FLARE

[75] Inventors: David W. Endicott, Jr., Mendon; Ross W. Guymon, Providence; James R. Kaminska, Honeyville, all of Utah

[73] Assignee: Thiokol Corporation, Ogden, Utah

[21] Appl. No.: 497,277

[22] Filed: Jun. 30, 1995

[51] Int. Cl.[6] ..... F42B 12/48; F42B 4/04; F42B 4/26

[52] U.S. Cl. ..... 102/334; 102/343; 102/361

[58] Field of Search ..... 102/334, 343, 102/361

[56] References Cited

U.S. PATENT DOCUMENTS

| | | | |
|---|---|---|---|
| H1,124 | 1/1993 | Rouse et al. | 60/39.75 |
| 3,478,686 | 11/1969 | Berg | 102/35 |
| 3,485,169 | 12/1969 | Lai | 102/37.8 |
| 3,670,657 | 6/1972 | Evans | 102/87 |
| 4,624,186 | 11/1986 | Wildera et al. | 102/336 |
| 5,025,729 | 6/1991 | Cameron | 102/336 |
| 5,074,216 | 12/1991 | Dunne et al. | 102/334 |
| 5,090,326 | 2/1992 | Altenau et al. | 102/395 |
| 5,136,950 | 8/1992 | Halpin et al. | 102/336 |
| 5,499,852 | 3/1996 | Schiessel et al. | 102/334 |

FOREIGN PATENT DOCUMENTS

| | | | |
|---|---|---|---|
| 583176 | 2/1994 | European Pat. Off. | 102/334 |
| 7927798 | 5/1981 | France | F42B 4/02 |
| 1097337 | 1/1961 | Germany . | |
| 2735118 | 2/1978 | Germany | F42B 15/14 |

*Primary Examiner*—Peter A. Nelson
*Attorney, Agent, or Firm*—Cushman Darby & Cushman IP Group of Pillsbury Madison & Sutro; Ronald L. Lyons, Esq.

[57] ABSTRACT

A decoy flare is disclosed which includes illuminant disposed within a housing. A shroud is slidably attached to the housing for deployment from a retracted position to an extended position. A plug is attached to the aft end of the shroud and is configured with a radially beveled, nozzle-contacting surface. The plug is positioned and configured to sealingly engage the nozzle when the shroud is in the retracted position and to disengage the nozzle upon deployment of the shroud to the extended position. The plug is configured with a plume-contacting surface positioned at an angle to the path of the plume when the shroud is in the extended position for enhancing the cross-sectional area of the plume of the flare.

27 Claims, 3 Drawing Sheets

NOZZLE PLUG FOR PLUME ENHANCEMENT IN A KINEMATIC FLARE

BACKGROUND

1. The Field of the Invention

The present invention is related to a nozzle plug which enhances the plume of a kinematic flare. More particularly, the present invention is related to a plug mounted at the aft end of an extendable shroud which seals the nozzle when the shroud is in a retracted position and is configured with a plume-contacting surface for enhancing the cross-sectional area of the plume when the shroud is in an extended position.

2. Technical Background

Decoy flares are used defensively by combat aircraft to evade heat-seeking missiles directed at such aircraft by an enemy. At an appropriate time after the enemy launches a heat-seeking missile, the targeted aircraft releases a decoy flare. The decoy flare burns in a manner that simulates the engines of the targeted aircraft. Ideally, the missile locks onto and pursues the decoy, permitting the targeted aircraft to escape unharmed.

Early decoy techniques utilized bundles of chaff, i.e., strips of metal which would reflect radar energy to counter radar guided missiles. The chaff bundles were housed in square or rectangular shaped cartridges which were held in correspondingly shaped dispensers on the aircraft.

As missile technology advanced, chaff bundles were accompanied by flares which produced infrared wavelength signatures greater than those produced by the engines of the target aircraft as interpreted by the heat seeking missile. Such infrared decoy flares were housed in dispensers which were previously used to carry chaff bundles. The flares are deployed by igniting an impulse cartridge which ejects the flare from the cartridge and triggers a chain of events which leads to the ignition of the flare illuminant.

Further missile technology advancements led to discriminating abilities in missiles to distinguish between the target aircraft and the decoy flare. This in turn has led to the development of kinematic, or fly-along, flares to beat or decoy the advanced discriminators found in the missiles. The kinematic flare is also deployed by igniting the impulse cartridge and ejecting the flare from its protective case.

The cases, magazines, and dispensers employed in connection with these prior technologies provide a design envelope defining the exterior dimensions of the decoy flare. Limitations on the length of new kinematic flares have been overcome by the implementation of telescoping shrouds. Such shrouds permit the flare to be stowed with the shroud in a retracted position and deploy and lock into an extended position upon firing of the flare. Increasing the effective length of the flare by the use of a telescoping shroud enables the aerodynamic characteristics of the flare to be enhanced, and allows better combustion of plume gases to occur.

The restrictions on the cross-sectional area of the flare which are imposed by the flare envelope limit the size of the plume which may be generated by the flare. Obviously, if the size of the flare's plume could be increased, the effectiveness of the flare as a decoy would be enhanced.

Safety regulations for such decoy flares require that flares satisfy "lock-set" test requirements. These requirements are designed to ensure that in the event the flare dispenser is plugged, thereby blocking physical deployment of the flare, ignition of the impulse cartridge will not trigger ignition of the flare illuminant. Generally this is accomplished by employing a safe-and-initiation device which prevents the illuminant from being ignited until the shroud is fully deployed, thereby ensuring that the flare dispenser has not been blocked prior to igniting the illuminant.

One disadvantage to the use of such safe-and-initiation devices is that they delay ignition of the illuminant until the telescoping shroud is fully deployed. Immediate ignition of the illuminant upon deployment of the flare is critical to the decoy functions of the flare. Thus, any delay between the firing of the impulse cartridge and the ignition of the illuminant is disadvantageous and should be reduced or eliminated.

From the foregoing, it will be appreciated that it would be an advancement in the art to provide a decoy flare having a plume with an enhanced cross-sectional area while preserving the physical dimensions of the flare, thereby enabling the flare to be stowed in the chaff dispensers typically found on military aircraft.

It would be a further advancement in the art to provide a flare which would satisfy lock-set test requirements while enabling immediate ignition of the illuminant upon the firing of the impulse cartridge to deploy the flare.

Such a flare is disclosed and claimed herein.

BRIEF SUMMARY AND OBJECTS OF THE INVENTION

The present invention is directed to a novel decoy flare having an enhanced plume and permitting immediate ignition of the flare illuminant upon deployment of the flare. In one embodiment, the present invention includes a flare having a housing with a nozzle configured in its aft end. The illuminant is disposed within the housing and is preferably tailored to produce light in the infrared spectrum.

The illuminant and housing are configured such that upon combustion of the illuminant, a plume of combustion gases is discharged through the nozzle along a path extending aftwards of the flare. The flare is also configured with a shroud which is slidably attached to the housing for deployment from a retracted position to an extended position. The shroud is maintained in the retracted position prior to firing of the flare.

Importantly, a plug is attached to the aft end of the shroud. In a preferred embodiment, the plug comprises a dispersing block configured with a plume-contacting surface positioned at an angle to the path of the plume when the shroud is in the extended position. Thus, during combustion of the illuminant, the plug acts to disperse the plume radially outwardly from the longitudinal axis of the flare, thereby increasing the effective cross-sectional area of the plume.

The plug is centrally positioned within the shroud by a mounting web. The mounting web permits combustion gases to pass through the web during combustion of the illuminant. Also, the plug is mounted within the shroud such that the plug does not extend beyond the aft end of the shroud, thereby ensuring that the utilization of the present invention does not require increasing the total length of the flare, particularly during storage.

The plug is configured with a radially beveled, nozzle-contacting surface. As used herein, "radially beveled" means that the cross-sectional area of the plug gradually increases towards the aft end of the plug, such as in a conical or pyramidal geometry. In a preferred embodiment, the nozzle-contacting surface comprises the same surface as the plume-contacting surface. Thus, if the nozzle is round, a plug shaped as a cone or conical frustum would preferably be employed. If the nozzle is square, a plug shaped as a pyramid or pyramidal frustum would be preferred.

The nozzle-contacting surface is configured to mate with the nozzle when the shroud is in its retracted position, thereby acting as a nozzle seal and preventing combustion gases or flames to propagate through the nozzle when the plug is in place. A sealant material, such as silicone, may be employed to ensure the effectiveness of the seal between the plug and the nozzle.

Upon deployment of the flare, the shroud moves from its retracted position towards its extended position, thereby breaking the seal and releasing the plug from its position of engagement with the nozzle. With the nozzle no longer sealed, ignition of the illuminant may then be immediately accomplished through the nozzle.

Thus, it is an object of the present invention to provide a decoy flare having a plume with an enhanced cross-sectional area while preserving the physical dimensions of the flare, thereby enabling the flare to be stowed in the chaff cartridges which are typically found on military aircraft.

It is an additional object of the present invention to provide a flare which would satisfy lock-set test requirements while enabling immediate ignition of the illuminant upon the firing of the impulse cartridge to deploy the flare.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
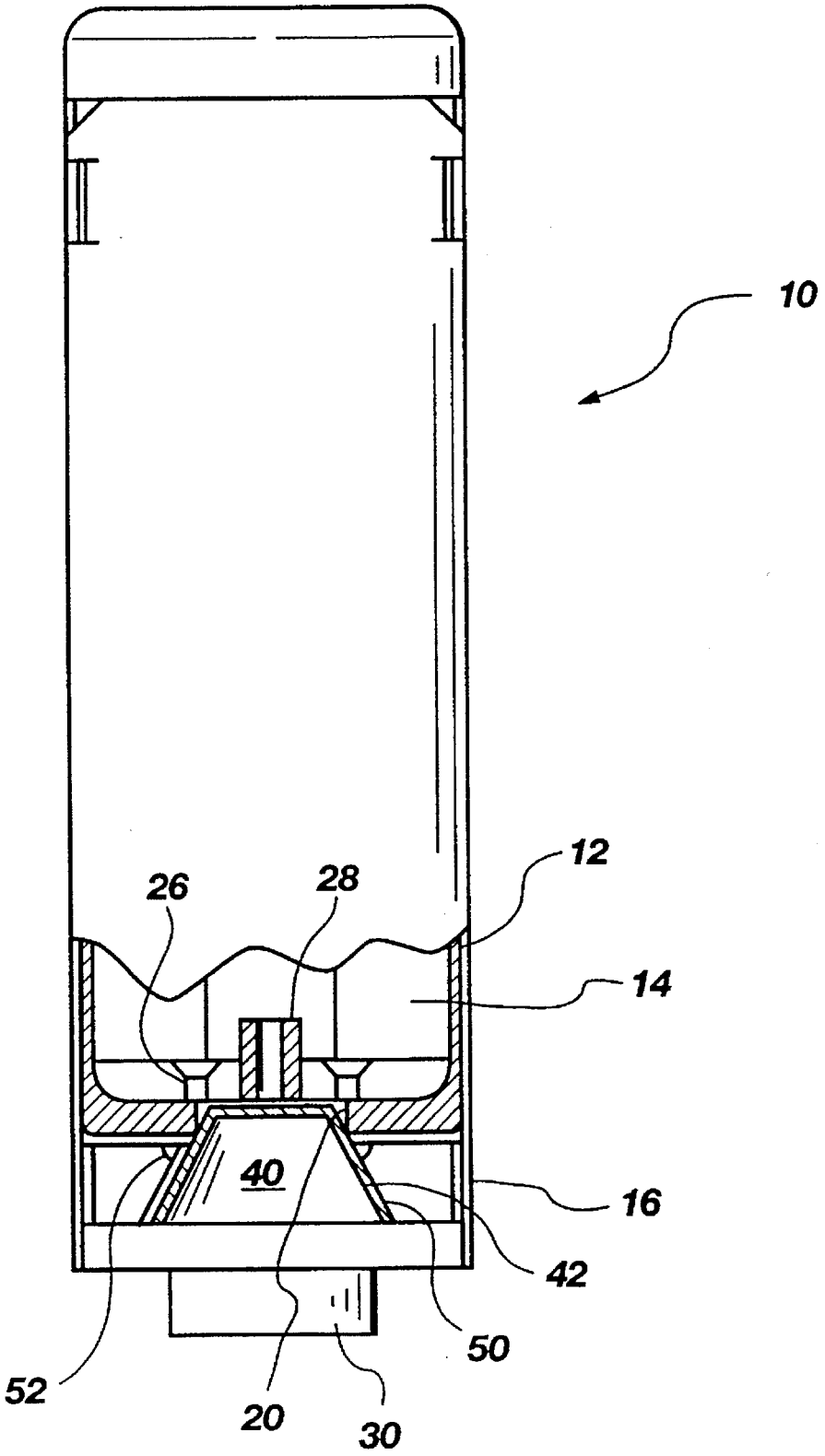
FIG. 1 is a side, plan view of one embodiment of a flare made according to the teachings of the present invention, with portions cut away to more effectively illustrate the invention.
Figure 2:
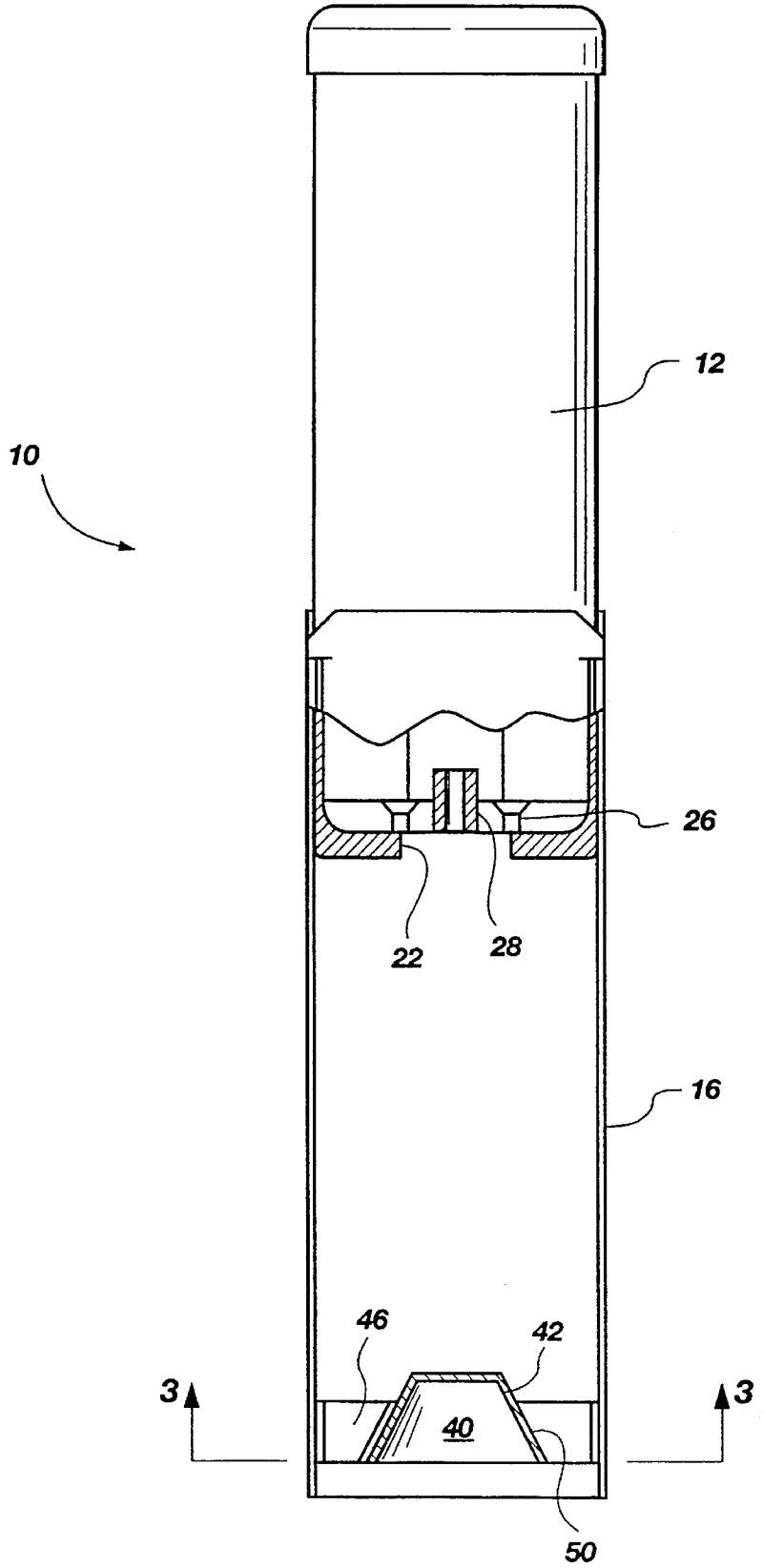
FIG. 2 is a side, plan view of the flare of FIG. 1, with the shroud in an extended position and portions of the flare cut away to better illustrate the invention.

Reference is now made to the figures wherein like parts are referred to by like numerals throughout. With particular reference to FIGS. 1 and 2, a decoy flare according to the present invention is generally designated at 10. The flare 10 includes a housing 12 in which illuminant 14 is disposed. In this preferred embodiment of the invention, the illuminant 14 is tailored to product light in the infrared spectrum.

The flare 10 also includes a shroud 16 which is slidably attached to the housing 12 for deployment from a retracted position, as illustrated in FIG. 1, to the extended position illustrated in FIG. 2. During storage of the flare, the shroud is maintained in the retracted position. Upon deployment of the flare and combustion of the illuminant, the shroud is deployed to the extended position. A locking mechanism maintains the shroud in the extended position.

For decoy flares 10 designed to be ejected from aircraft, the flare 10 is preferably configured to be approximately eight inches long with the shroud 16 in the retracted position (FIG. 1), thereby enabling it to be compatible with preexisting chaff dispensers utilized on many military aircraft. With the shroud 16 deployed to its extended position (FIG. 2), the overall length of the flare 10 is approximately 12 inches. Of course, restrictions on flare length, with the shroud in either the retracted or extended position, may vary depending on the particular application for which the flare is to be used. Advantageously, implementation of the present invention does not add to the length of the flare.

The housing 12 and shroud 16 may be manufactured of any of those materials known for use in such an application, but are preferably made of carbon steel.

Figure 3:
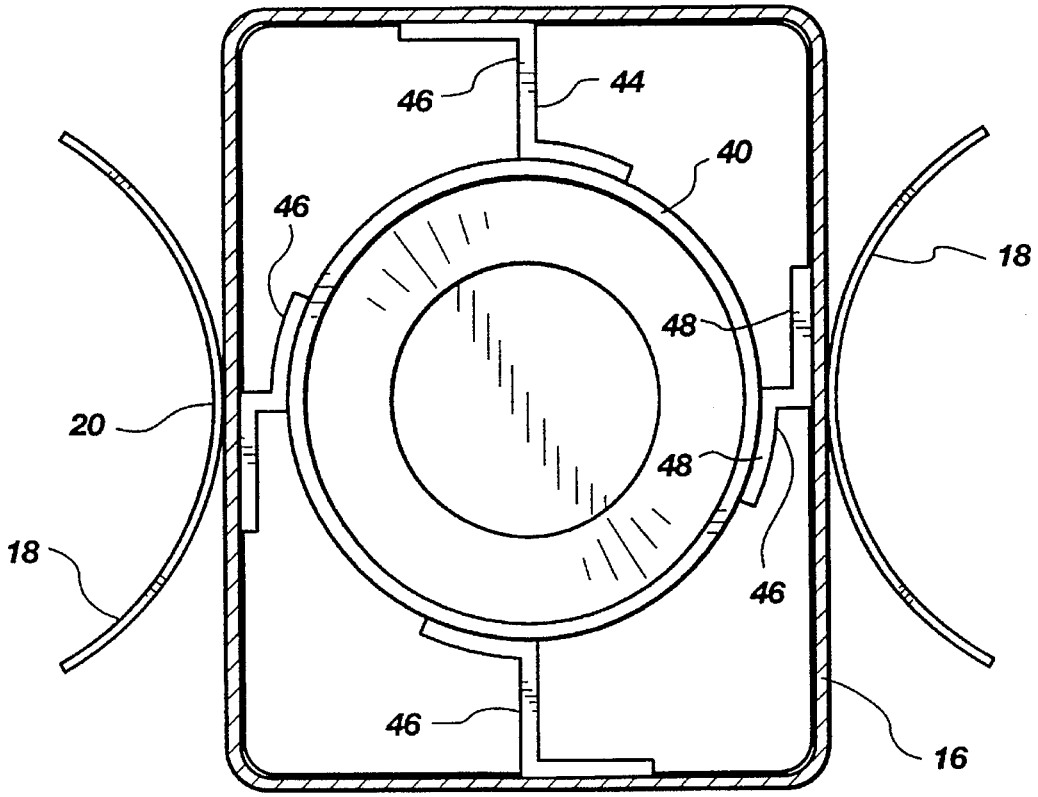
FIG. 3 is a cross-sectional view taken along line 3—3 of FIG. 2.

As illustrated in FIG. 3, a pair of fins 18 are attached the shroud 16 towards the aft end of the shroud. The fins are generally configured as half cylindrical shells and are attached to the shroud along a centerline 20. As is known in the art, the fins 18 are made of a flexible material thereby permitting them to lie substantially flat against the shroud. Thus, the flare may be stowed in a rectangular dispenser having approximately the same cross-sectional geometry as the shroud. Upon deployment of the flare, the fins 18 are released to assume the configuration illustrated in FIG. 3 and assist in providing aerodynamic stability to the flare during flight.

With continued reference to FIGS. 1 and 2, the aft end of the housing 12 is configured with a nozzle 22 through which combustion gases are discharged during combustion of the illuminant 14. The nozzle 22 may be configured with a variety of geometries, but is preferably round. Thus, upon combustion of the illuminant 14, a plume of combustion gases is discharged through the nozzle 22 and along a path extending aftwards of the flare.

A plurality of standoffs 26 may be positioned within the housing 12 to provide structural support at the aft end of the illuminant 14. The standoffs 26 may be made of graphite or any other heat-resistant material.

An ignition pellet 28 is positioned at the aft end of the illuminant 14 such that combustion of the ignition pellet 28 will initiate combustion of the illuminant 14. In this preferred embodiment, the ignition pellet 28 comprises a boron potassium nitrate ($BKNO_3$) pellet; however, as one of skill in the art will appreciate, a variety of illuminant ignition mechanisms may be employed.

Though not physically connected to the flare 10, an impulse cartridge 30 (FIG. 1) is provided within the case which contains the flare and is positioned such that it is located adjacent the aft end of the shroud 16. The impulse cartridge 30 may include any of those conventional ignition mechanisms, such as squibs, which are known for use as ignition mechanisms for flares. The impulse cartridge 30 receives an electrical signal from contacts in the dispenser which ignite the material found in the impulse cartridge, thereby producing a flame and gas which eject the flare from the case and trigger ignition of the ignition pellet 28.

In accordance with the teachings of the present invention, the flare 10 includes a plug 40 which is attached to the aft end of the shroud. The plug 40 is preferably configured to act as a dispersing block and, in this preferred embodiment, includes a plume-contacting surface 42. The plume-contacting surface 42 is positioned at an angle to the path of the plume when the shroud is in the extended position (FIG. 2).

The plume-contacting surface 42 may be made of any of a number of heat-resistant materials, such as a ceramic or other ablative, and in this preferred embodiment is made of carbon steel.

With reference now to FIG. 3, the plug is centrally positioned within the shroud 16 by a mounting web 44. In this preferred embodiment, the mounting web 44 includes four radially positioned spokes 46. Each spoke 46 is configured with attachment surfaces 48 for mounting to the plug 40 and the interior wall of the shroud 16. The spokes may be attached by a variety of methods, but are preferably attached by welding.

In this presently preferred embodiment of the invention, the plug 40 is configured to sealingly engage the nozzle 22 when the shroud 16 is in its retracted position, as illustrated in FIG. 1. Thus, with the shroud 16 in the retracted position, the plug 40 acts as a nozzle seal and prevents combustion gases or flames from propagating through the nozzle when the plug is in place. In the event the impulse cartridge 30 should inadvertently fire without the flare being allowed to deploy, the nozzle seal would prevent the combustion of the impulse cartridge 30 from igniting the illuminant and leading to more catastrophic consequences.

To ensure a positive seal between the plug 40 and the nozzle 22, the plug 40 is preferably configured with a radially beveled, nozzle-contacting surface 50. Such a radially beveled surface 50 provides a swage-like fit of the plug 40 within the nozzle 22, thereby enhancing the security of the seal between the plug 40 and the nozzle 22. The nozzle-contacting surface 50 may be made of the same material as the plug 40, and in this preferred embodiment is made of carbon steel.

This swage-like fit is achieved by employing a plug having a radially beveled, nozzle-contacting surface 50 whose cross section corresponds to the geometry of the opening of the nozzle 22. Hence, if the nozzle is round, a plug shaped as a cone or conical frustum could be utilized. For a square nozzle, a plug shaped as a pyramid or pyramidal frustum would be preferred. As illustrated in FIGS. 1 and 2, the presently preferred embodiment of the invention employs a plug 40 shaped as a conical frustum.

In this preferred embodiment, the nozzle-contacting surface 50 is advantageously configured to be the same surface as the plume-contacting surface 42. In alternative embodiments, however, it may be desirable to provide different surfaces to achieve these different functions.

To further ensure the effectiveness of the seal between the plug 40 and the nozzle 22 when the shroud 16 is in its retracted position, a sealant material 52, such as silicone, is preferably placed on the seal. Upon deployment of the flare, the seal provided by the sealant material 52 is broken as the shroud 16 moves from its retracted position to its extended position.

In operation, the flare 10 of the present invention is prepared by loading it with illuminant 14 tailored to produce a predetermined radiation signature upon combustion. The shroud is placed into the retracted position, as illustrated in FIG. 1, thereby sealingly engaging the plug 40 to the nozzle 20. Sealant material 52 is preferably placed around the nozzle prior to engaging the plug with the nozzle.

The flare 10 is then ready to be placed in a flare case for loading into a magazine which loads into the dispenser found on an aircraft. The flare is deployed by firing the impulse cartridge 30. The expansion of gases resulting from the combustion of the impulse cartridge 30 simultaneously ejects the flare from the flare dispenser and causes the shroud 16 to deploy to the extended position illustrated in FIG. 2.

As deployment of the shroud 16 commences, the plug 40 is separated from the nozzle 20, thereby breaking the nozzle seal and immediately permitting the combustion gases from the impulse cartridge 30 to flow into the housing 12 and causing the ignition pellet 28 to ignite. Combustion of the ignition pellet 28 ignites the illuminant 14.

As the illuminant 14 combusts, a plume of combustion products exits the flare by traveling along a path extending aftwards of the flare, through the nozzle 20, and down the shroud 16. As the plume reaches the aft end of the shroud 16, it comes into contact with the plume-contacting surface 42 of the plug 40. Because the plume-contacting surface 42 is positioned at an angle to the path of the plume, the plume-contacting surface 42 directs the plume radially outwardly from the longitudinal axis of the flare, thereby substantially increasing the effective cross-sectional area of the signature of the flare.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for enhancing the signature of a flare, the flare including a housing with illuminant disposed within the housing and a nozzle positioned at the aft end of the housing, the flare configured to discharge a plume of combustion gases through the nozzle and along a path extending aftwards of the flare during combustion of the illuminant, comprising;

a dispersing block positioned within the path of the plume, the dispersing block configured with a plume-contacting surface positioned at an angle to the path of the plume; and means for positioning the dispersing block within the path of the plume.

2. An apparatus for enhancing the signature of a flare as defined in claim 1, wherein the dispersing block is configured as a cone.

3. An apparatus for enhancing the signature of a flare as defined in claim 1, wherein the dispersing block is configured as a conical frustum.

4. An apparatus for enhancing the signature of a flare as defined in claim 1, wherein the dispersing block is configured as a pyramid.

5. An apparatus for enhancing the signature of a flare as defined in claim 1, wherein the dispersing block is configured as a pyramidal frustum.

6. An apparatus for enhancing the signature of a flare as defined in claim 1, wherein the flare also includes a shroud which extends aftward of the housing and wherein the positioning means is configured to attach the dispersing block to the aft end of the shroud.

7. An apparatus for enhancing the signature of a flare as defined in claim 6, wherein the positioning means is configured to position the dispersing block within the shroud such that the dispersing block does not extend beyond the aft end of the shroud.

8. An apparatus for enhancing the signature of a flare as defined in claim 6, wherein the positioning means includes a mounting web which centrally positions the dispersing block within the shroud, the mounting web configured to permit combustion gases to pass through the web during combustion of the illuminant.

9. An apparatus for enhancing the signature of a flare as defined in claim 8, wherein the mounting web comprises a plurality of radially positioned spokes.

10. A flare, comprising:

a housing including a nozzle configured in its aft end;

illuminant disposed within the housing;

a shroud slidably attached to the housing for deployment from a retracted position to an extended position; and a plug attached to the shroud, the plug positioned and configured to sealingly engage the nozzle when the shroud is in the retracted position and to disengage the nozzle upon deployment of the shroud to the extended position.

11. A flare as defined in claim 10, further comprising a sealant material to seal the plug to the nozzle when the shroud is in the retracted position.

12. A flare as defined in claim 11, wherein the sealant material comprises silicone.

13. A flare as defined in claim 10, wherein the plug includes a nozzle-contacting surface which is radially beveled.

14. A flare as defined in claim 13, wherein the nozzle is round and the plug is configured as a conical frustum.

15. A flare as defined in claim 13, wherein the nozzle is square and the plug is configured as a pyramidal frustum.

16. A flare as defined in claim 10, wherein the flare is configured to discharge a plume of combustion gases through the nozzle and along a path extending aftwards of the flare during combustion of the illuminant, and wherein the plug comprises a dispersing block positioned within the path of the plume, the dispersing block configured with a plume-contacting surface positioned at an angle to the path of the plume.

17. A flare as defined in claim 16, wherein the dispersing block is configured as a cone.

18. A flare as defined in claim 16, wherein the dispersing block is configured as a pyramid.

19. A flare as defined in claim 16, wherein the dispersing block is attached to the aft end of the shroud.

20. A flare as defined in claim 19, wherein the dispersing block is attached to the shroud such that the dispersing block does not extend beyond the aft end of the shroud.

21. A flare as defined in claim 19, further comprising a mounting web which centrally positions the dispersing block within the shroud, the mounting web configured to permit combustion gases to pass through the web during combustion of the illuminant.

22. A decoy flare, comprising:

a housing including a nozzle configured in its aft end;

illuminant disposed within the housing such that during combustion of the illuminant, a plume of combustion gases is discharged through the nozzle along a path extending aftwards of the flare;

a shroud slidably attached to the housing for deployment from a retracted position to an extended position;

a plug attached to the aft end of the shroud, the plug configured with a radially beveled, nozzle-contacting surface, the plug positioned and configured to sealingly engage the nozzle when the shroud is in the retracted position and to disengage the nozzle upon deployment of the shroud to the extended position, the plug comprising a dispersing block configured with a plume-contacting surface positioned at an angle to the path of the plume when the shroud is in the extended position; and a mounting web which centrally positions the dispersing block within the aft end of the shroud such that the dispersing block does not extend beyond the aft end of the shroud, the mounting web configured to permit combustion gases to pass through the web during combustion of the illuminant.

23. A decoy flare as defined in claim 22, further comprising a sealant material to seal the plug to the nozzle when the shroud is in the retracted position.

24. A decoy flare as defined in claim 23, wherein the sealant material comprises silicone.

25. A decoy flare as defined in claim 22, wherein the nozzle is round and the plug is configured as a conical frustum.

26. A decoy flare as defined in claim 22, wherein the nozzle is square and the plug is configured as a pyramidal frustum.

27. A decoy flare as defined in claim 22, wherein the mounting web comprises a plurality of radially positioned spokes.

* * * * *